US007391988B2

(12) United States Patent
Igarashi et al.

(10) Patent No.: US 7,391,988 B2
(45) Date of Patent: Jun. 24, 2008

(54) IMAGE FORMING APPARATUS AND BELT DEVICE

(75) Inventors: Hiroshi Igarashi, Nagoya (JP); Tsunemitsu Fukami, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/258,930

(22) Filed: Oct. 27, 2005

(65) Prior Publication Data

US 2006/0093395 A1 May 4, 2006

(30) Foreign Application Priority Data

Oct. 29, 2004 (JP) ..... 2004-317219

(51) Int. Cl.
*G03G 15/16* (2006.01)
*G03G 15/01* (2006.01)

(52) U.S. Cl. ..... 399/101; 399/303

(58) Field of Classification Search ..... 399/101, 399/297, 302, 303
See application file for complete search history.

(56) References Cited

U.S. PATENT DOCUMENTS 5,159,392 A 10/1992 Kasahara et al.
5,926,670 A * 7/1999 Furuta et al. ..... 399/101
6,295,437 B1 9/2001 Hodoshima et al.
6,741,821 B2 5/2004 Sugino et al.
2005/0053388 A1 * 3/2005 Yokoyama et al. ..... 399/302 X

FOREIGN PATENT DOCUMENTS

| | | |
|---|---|---|
| JP | 10186906 | 7/1998 |
| JP | 2000194192 | 7/2000 |
| JP | 2001034082 | 2/2001 |
| JP | 2001092221 | 4/2001 |
| JP | 2001282006 A * | 10/2001 |
| JP | 2003050521 | 2/2003 |
| JP | 2003066735 | 3/2003 |
| JP | 2003084476 | 3/2003 |
| JP | 2003295631 | 10/2003 |

* cited by examiner

*Primary Examiner*—David M. Gray
*Assistant Examiner*—Erika J. Villaluna
(74) *Attorney, Agent, or Firm*—Banner & Witcoff, Ltd

(57) ABSTRACT

An image forming apparatus includes: a plurality of rollers including at least one drive roller to be rotatively driven; a belt passed around the plurality of rollers; and a press member which is disposed opposite the drive roller with the belt interposed therebetween and presses the belt against the drive roller.

12 Claims, 7 Drawing Sheets

IMAGE FORMING APPARATUS AND BELT DEVICE

The present disclosure relates to the subject matter contained in Japanese Patent Application No. 2004-317219 filed Oct. 29, 2004, which is incorporated herein by reference in its entirety.

TECHNICAL FIELD

One aspect of the present invention relates to an image-forming apparatus, such as a laser printer, as well as to a belt device attached to the image-forming apparatus.

BACKGROUND

In relation to an image-forming apparatus, such as a laser printer, a method for transferring a toner image formed on the surface of a photosensitive drum to paper transported by a paper transport belt and a method for temporarily transferring to an intermediate transfer belt a toner image formed on the surface of the photosensitive drum and again transferring the toner image from the intermediate belt to paper have hitherto been known.

Belts, such as a paper transport belt and an intermediate transfer belt, are passed around a drive roller—to which driving force is input—and a driven roller spaced a predetermined interval from the drive roller, so as to contact the surface of the photosensitive drum. Therefore, toner may be transferred to and adhere to the surface of the belt when the belt has contacted the photosensitive drum, or paper dust may adhere to the surface of the belt when the belt has contacted paper.

The image forming apparatus having such a belt is provided with a cleaning blade for removing deposits, such as toner and paper dust, adhering to the surface of the belt (See JP-A-2003-50521). The cleaning blade is pressed against the surface of the belt at a position upstream of the driven roller in the traveling direction of the belt, to thus scrape the deposits adhering to the surface of the belt.

SUMMARY

However, when a member, such as the cleaning blade, has been brought into contact with the surface of the belt, the member exerts resistance to travel of the belt, which in turn induces a sag in a position on the belt upstream of the member pressed against the surface of the belt. Consequently, the belt comes out of contact with the drive roller, thereby rendering the driving (traveling) of the belt unstable.

Accordingly, an object of one aspect of the present invention is to provide an image-forming apparatus capable of stably driving a belt, as well as a belt device.

One aspect of the invention may provide an image forming apparatus including: a plurality of rollers including at least one drive roller to be rotatively driven; a belt passed around the plurality of rollers; and a press member which is disposed opposite the drive roller with the belt interposed therebetween and presses the belt against the drive roller.

Another aspect of the invention may provide a belt device to be removably attached to an image forming apparatus that has a main body. The device includes: a plurality of rollers including at least one drive roller to be rotatively driven; a belt passed around the plurality of rollers; a press member disposed opposite the drive roller with respect to the belt and presses the belt against the drive roller; and a frame retains the plurality of rollers, the belt, and the press member so that the plurality of rollers, the belt, and the press member can be integrally removed from or attached to the main body.

BRIEF DESCRIPTION OF THE DRAWINGS

One aspect of the present invention may be more readily described with reference to the accompanying drawings.

DETAILED DESCRIPTION

Figure 1:
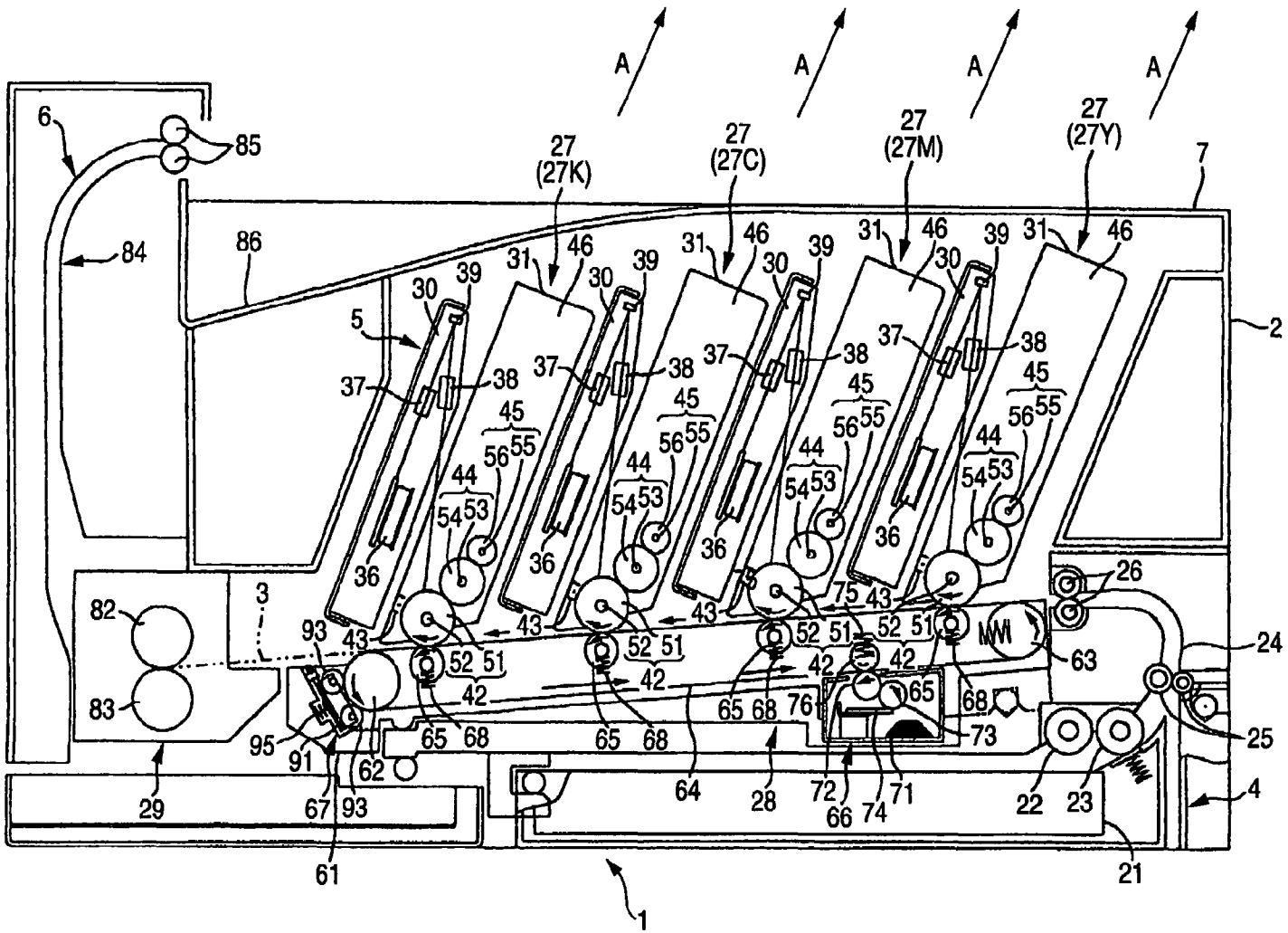
FIG. 1 is a side cross-sectional view showing an embodiment of a color laser printer employed as an image-forming apparatus.

FIG. 1 is a side cross-sectional view showing an embodiment of a color laser printer employed as an image-forming apparatus of one aspect of the present invention.

The color laser printer 1 is a tandem, landscape color laser printer, wherein a plurality of process sections 27 are arranged side by side in a horizontal direction. A paper-feeding section 4 for feeding a sheet of paper 3 employed as a recording medium, an image-forming section 5 used for forming an image on the fed sheet of paper 3, and a paper-eject section 6 for ejecting the sheet of paper 3 on which the image is formed are provided within a main body casing 2.

The main body casing 2 assumes a box shape whose upper side is opened and which has an essentially-rectangular profile when viewed from the side, and a top cover 7 is placed on top of the main body casing 2. The top cover 7 is supported so as to be pivotable around a cover shaft (not shown) provided an the back of the main body casing 2 (hereinafter, the left and right sides in FIG. 1 will be called "back" and "front" sides, respectively), and is provided to be able to open or close with respect to the main body casing 2.

The paper-feeding section 4 comprises a paper-feeding tray 21 which is removably, horizontally attached to an internal bottom portion of the main body casing 2 from the front thereof; a pickup roller 22 and a paper-feeding roller 23 which serve as feeding means and recording-medium feeding rollers and are provided at positions above the front side of the paper-feeding tray 21; a paper-feeding-side U-shaped path 24 provided at a position above the front side of the paper-feeding roller 23; and a transport roller 25 and a registration roller 26, both of which are provided at arbitrary positions on the paper-feeding-side U-shaped path 24.

The sheets of paper 3 are stacked in the paper-feeding tray 21, and the topmost sheet of paper among the sheets of paper 3 is picked up by the pickup roller 22 and transported forward, and is then fed to the paper-feeding-side U-shaped path 24 by means of the paper-feeding roller 23.

The paper-feeding-side U-shaped path 24 is formed as an essentially—U-shaped path for transporting the sheets of paper 3 such that an upstream end of the path is adjacent to the paper-feeding roller 23 at a lower position; such that the sheet of paper 3 is fed forward; such that a downstream end of the same is adjacent to a transport belt 64, which will be described later, at a higher position; and such that the sheet of paper 3 is ejected rearward.

The sheet of paper 3 having been fed forward to the upstream-side end of the paper-feeding-side U-shaped path 24 by the paper-feeding roller 23 is transported by the transport roller 25 in the paper-feeding-side U-shaped path 24, and the transporting direction of the sheet of paper 3 is reversed. After having been registered, the sheet of paper 3 is ejected rearward by the registration roller 26.

The image-forming section 5 has the process sections 27, a transfer section 28, and a fusing section 29.

The process sections 27 are provided for toner of a plurality of colors. Specifically, the process sections 27 consist of a yellow process section 27Y, a magenta process section 27M, a cyan process section 27C, and a black process section 27K. The process sections 27 are sequentially arranged so as to horizontally overlap each other while being spaced apart from each other in the longitudinal direction.

Each of the process sections 27 has a scanner unit 30 employed as an exposure device fixedly provided in each process section 27, and a process cartridge 31 removably attached to each of the process sections 27.

The scanner unit 30 has a laser emission section (not shown), a polygon mirror 36, two lenses 37, 38, and a reflecting mirror 39. In the scanner unit 30, the laser beam that is illuminated from the laser emission section on the basis of image data is reflected by the polygon mirror 36, and sequentially passes through or is reflected by the lens 37, the reflecting mirror 39, and the lens 38, to thus go out toward a photosensitive drum 42 to be described later.

Each of the process cartridges 31 is formed so as to be removably attachable in a direction inclined with respect to the longitudinal and vertical directions (the thicknesswise direction of the sheet of paper 3) as well as in a direction inclined rearwardly from the vertical (i.e., a direction where the upper portion of the process cartridge is inclined forward: denoted by arrows A in FIG. 1). Each process cartridge 31 has the photosensitive drum 42; a scorotoron electrification device 43; a development roller 44, and a feeding roller 45.

The photosensitive drum 42 has a drum main body 51 which assumes a cylindrical shape and is formed from a positively-electrified photosensitive layer whose outermost layer is formed from polycarbonate; and a drum shaft 52 extending in the axial direction of the drum main body 51 along the axial center thereof. The drum main body 51 is provided to be rotatable around the drum shaft 52, and the drum shaft 52 is supported in a nonrotatable manner on both side walls of the enclosure of the process cartridge 31 in the transverse direction thereof (a direction orthogonal to the longitudinal direction and the vertical direction; the same also applies to any counterparts in the following descriptions). During the image-forming operation, the photosensitive drum 42 is rotationally driven in a direction (a clockwise direction in the drawing) identical with the traveling direction of a transport belt 64, which will be described later, at the position (the image-forming position) where the photosensitive drum 42 comes into contact with the transport belt 64.

The scorotoron electrification device 43 is a positively-electrified scorotoron-type electrification device which has a wire and a grid and generates corona discharge. The scorotoron electrification device 43 is positioned opposite the photosensitive drum 42 at a position rearward thereof so as not to contact the photosensitive drum 42.

The development roller 44 is located opposite the photosensitive drum 42 at a position above the same, and remains pressed contact with the photosensitive drum 42. The development roller 44 is formed by coating a metal roller shaft 53 with a roller portion 54 which is formed from an elastic member such as a conductive rubber material. More specifically, the roller portion 54 is formed into a two-layer structure consisting of a roller section of an elastic body and a coating layer. The roller section is formed from conductive urethane rubber or silicon rubber, both of which contain fine carbon particles, or EPDM rubber. The coating layer to be applied over the surface of the roller section is formed from a principal constituent such as urethane rubber, a urethane resin, or a polyimide resin. The roller shaft 53 is rotatably supported on both side walls in the transverse direction of the process cartridge 31.

The feeding roller 45 is disposed opposite the development roller 44 at a position above the development roller 44 and remains in pressed contact with the development roller 44. In this feeding roller 45, a metal roller shaft 55 is coated with a roller portion 56 made of a conductive spongy material. The roller shaft 55 is rotatably supported on both side walls of the process cartridge 31 in the transverse direction thereof.

An upper area in the process cartridge 31 is formed as a toner-housing chamber 46 for housing toner. Toner of respective colors is housed in the toner-housing chamber 46. Specifically, toner is stored in the toner-housing chambers 46 of the respective process sections 27; namely, positively-electrified, nonmagnetic, one-component polymer toner of yellow color is stored in the yellow process section 27Y; positively-electrified, nonmagnetic, one-component polymer toner of magenta color is stored in the magenta process section 27M; positively-electrified, nonmagnetic, one-component polymer toner of cyan color is stored in the cyan process section 27C; and positively-electrified, nonmagnetic, one-component polymer toner of black color is stored in the black process section 27K.

More specifically, substantially-spherical polymer toner particles obtained by the polymerization method are used as toner of the respective colors. A styrene-based monomer such as styrene and an acrylic monomer such as an acrylic acid, alkyl (C1 to C4) acrylate, or alkyl (C1 to C4) meta-acrylate are copolymerized by a known polymerization method such as suspension polymerization, to thus obtain a binding resin. The thus-obtained binding agent is formulated, while being taken as a principal constituent, together with a coloring agent, a charge-controlling agent, and wax, thereby forming toner base particles. External additives are added to the toner base particles with a view toward enhancing fluidity. Thus, the polymer toner is formed.

The yellow coloring agent, the magenta coloring agent, the cyan coloring agent, and the black coloring agent, all of which are described above, are formulated as coloring agents. A charge-controlling resin is obtained by copolymerization of an ionic monomer having an ionic functional group, such as ammonium salt, with a monomer which can be copolymerized with an ionic monomer, such as a styrene-based monomer or an acrylic monomer. This charge-controlling resin is formulated as the charge-controlling agent. For instance, powder of metallic oxides such as silica, an aluminium oxide, a titanium oxide, strontium titanate, a cerium oxide, or a magnesium oxide; or inorganic powder such as a powder of a carbide or a powder of a metallic salt, are formulated as external additives.

During the image-forming operation, in each of the respective process sections 27, the toner of respective colors stored in the toner-housing chamber 46 is fed to the feeding roller 45. The toner is further fed to the development roller 44 by means of rotation of the feeding roller 45. At this time, the toner is positively, frictionally electrified between the feeding roller 45 and the development roller 44 under application of a development bias.

Meanwhile, the scorotoron electrification device 43 generates a corona discharge by means of application of an electrification bias, to thus uniformly, positively electrify the surface of the photosensitive drum 42. After having been uniformly, positively electrified by the scorotoron electrification device 43 in association with rotation of the photosensitive drum 42, the surface of the photosensitive drum 42 is exposed to a high-speed scan of the laser beam emitted from the scanner unit 30, whereupon an electrostatic latent image corresponding to the image to be formed on the sheet of paper 3 is formed.

As a result of further rotation of the photosensitive drum 42, when the toner, which has been applied over the surface of the development roller 44 and positively electrified, opposes and contacts the photosensitive drum 42 by means of rotation of the development roller 44, the toner is supplied to the electrostatic latent image formed on the surface of the photosensitive drum 42; namely, exposed areas on the uniformly, positively-electrified surface of the photosensitive drum 42 where electric potentials have been reduced upon exposure to the laser beam. As a result, the electrostatic latent image of the photosensitive drum 42 is visualized, and toner images of respective colors are formed on the surface of the photosensitive drum 42 by means of reversal development.

The process cartridges 31 of respective colors are set at higher positions in a direction closer to the front of the process section 27. Specifically, the positions where the process cartridges 31 are placed are set so as to become higher from one process section 27 to an adjacent process section 27 by a predetermined level, in increasing sequence of the black process section 27K, the cyan process section 27C, the magenta process section 27M, and the yellow process section 27Y.

The transfer section 28 is longitudinally placed in a position above the paper-feeding section 4 and below the respective process sections 27 within the main body casing 2. The transfer section 28 has a frame 61 which is removably attached to the main body casing 2 from the front in the horizontal direction and serves as an opposing member; and a drive roller 62, a driven roller 63, the transport belt 64, a transfer roller 65, a cleaning device 66, and a press mechanism 67, all of which are retained by the frame 61.

The drive roller 62 is placed in a position which is behind the photosensitive drum 42 of the process cartridge 31 to be attached to the black process section 27K and which is at a level where the drive roller 62 does not overlap the photosensitive drum 42 in the horizontal direction. During an image-forming operation, the drive roller 62 is rotationally driven in a direction opposite the rotational direction of the photosensitive drum 42 (the counterclockwise direction in the drawing).

The driven roller 63 is located at a position above the drive roller 62 and ahead of the photosensitive drum 42 of the process cartridge 31 to be attached to the yellow process section 27Y. During rotational driving of the drive roller 62, this driven roller 63 is driven and rotated in the same direction (the counterclockwise direction in the drawing) as the traveling direction of the transport belt 64 achieved in a position where the driven roller 63 contacts the transport belt 64 and which will be described later.

The transport belt 64 is formed from an endless belt, and made of conductive resin, such as polycarbonate or polyimide, wherein conductive particles such as carbon are dispersed. This transport belt 64 is stretched, in a winding manner, between the drive roller 62 and the driven roller 63. An upper portion (an area where the driven roller 63 is positioned in an upstream position and the drive roller 62 is positioned in a downstream position in the traveling direction of the transport belt 64) extends in the form of an inclined plane which becomes higher in a direction close to the front, as well as opposing and contacting, from below, the photosensitive drums 42 of the process cartridges 31 attached to the respective process sections 27.

By means of driving action of the drive roller 62, the driven roller 63 is driven, whereby the transport belt 64 is rotated in a circulating manner between the drive roller 62 and the driven roller 63 in the same direction as is the photosensitive drum 42, in the image-forming position where the transport belt 64 contacts, in an opposing manner, the photosensitive drums 42 of the respective process sections 27. At this time, the drive roller 62 is placed in a downstream position and the driven roller 63 is placed in an upstream position with respect to the position where the drive roller 62 comes into contact with the photosensitive drum 42 of the transport belt 64 along the traveling direction. As a result, occurrence of a sag in the upstream portion of the transport belt 64 that opposes the photosensitive drum 42 can be prevented. Therefore, the sheet of paper 3 can be transported with high accuracy by means of the transport belt 64.

The transfer rollers 65 are provided, within the transport belt 64 stretched, in a winding manner, between the drive roller 62 and the driven roller 63, so as to oppose the photosensitive drums 42 of the respective process sections 27 with the transport belt 64 therebetween. The transfer roller 65 is impelled by a compression spring 68 at all times in the direction where the transfer roller 65 is pressed against the photosensitive drum 42. In this transfer roller 65, a metal roller shaft is coated with a roller portion made of an elastic member such as a conductive rubber material. The transfer roller 65 is provided, in the image-forming position where the transfer roller 65 opposes and contacts the transport belt 64, so as to be able to rotate in the same direction where the transport belt 64 is moved in a circulating manner. During transfer operation, a transfer bias is applied to the transfer rollers 65.

The sheet 3 having been fed from the paper-feeding section 4 is transported from front to back by the transport belt 64, which is moved in a circulating manner by driving action of the drive roller 62 and driven action of the driven roller 63, so as to sequentially pass through image-forming positions between the transport belt 64 and the photosensitive drums 42 of the respective process sections 27. During the course of transport operation, the toner images of respective colors formed on the photosensitive drums 42 of the respective process sections 27 are sequentially transferred, whereby a color image is formed on the sheet of paper 3.

For example, when the yellow toner image formed on the surface of the photosensitive drum 42 of the yellow process section 27Y is transferred to the sheet of paper 3, the magenta toner image formed on the surface of the photosensitive drum 42 of the magenta process section 27M is then transferred, in an overlapping manner, on the sheet of paper 3 where the yellow toner image has already been transferred. By means of similar operation, the cyan toner image formed on the surface of the photosensitive drum 42 of the cyan process section 27C and the black toner image formed on the surface of the photosensitive drum 42 of the black process section 27K are transferred in an overlapping manner. As a result, the color image is formed on the sheet of paper 3.

In relation to formation of such a color image, this color laser printer 1 has the configuration of a tandem device, wherein the plurality of process cartridges 31 are provided for respective colors in the respective process sections 27. Therefore, toner images of respective colors are formed at substantially the same speed at which a monochrome image is formed. Quick formation of a color image can be attained. For this reason, a color image can be formed while an attempt for miniaturization is realized.

The cleaning device 66 is placed in a comparatively large space (larger than the space formed in close proximity to the drive roller 62) formed in close proximity to the driven roller 63 between the bottom face of the frame 61 and the transport belt 64. This cleaning device 66 has a cleaning box 71, a primary cleaning roller 72 serving as a cleaning member, a secondary cleaning roller 73, and a cleaning blade 74.

The cleaning box 71 assumes the shape of a box. An opening section is formed in a part of a face of the cleaning box 71 opposing the lower-side area of the transport belt 64 (i.e., the area where the drive roller 62 is positioned at an upstream location and the driven roller 63 is positioned at a downstream location with respect to the traveling direction of the transport belt 64). The internal space of the opening section is formed as a removed-substance storage section for storing deposits, such as toner or paper dust, scraped by the cleaning blade 74.

The primary cleaning roller 72 is formed from a roller made of silicon rubber foam or urethane rubber foam, and is pivotably supported in the opening section of the cleaning box 71. Further, the primary cleaning roller 72 remains in contact with the surface of the lower-side area (the lower surface) of the transport belt 64. An impelled roller 76—which is impelled toward the primary cleaning roller 72 by a compression spring 75—is placed at a position, within the transport belt 64, where the impelled roller 76 opposes the primary cleaning roller 72 with the transport belt 64 sandwiched therebetween. The primary cleaning roller 72 remains in pressed contact with the transport belt 64 as a result of the impelling roller 76 pressing against the transport belt 64. During cleaning operation, the primary cleaning roller 72 is rotationally driven in a direction (a counterclockwise direction in the drawing) opposite to the transporting direction of the transport belt 64 at the position where the primary cleaning roller 72 contacts the transport belt 64. A predetermined cleaning bias is applied to the primary cleaning roller 72 and, in turn, to the transport belt 64.

The secondary cleaning roller 73 is formed from a metal roller, and is positioned in a contacting manner so as to face the primary cleaning roller 72 at a position opposite the primary cleaning roller 72 with the transport belt 64 sandwiched therebetween. During the cleaning operation, the secondary cleaning roller 73 is rotationally driven in a direction opposite to the rotational direction of the primary cleaning roller 72 (the clockwise direction in the drawing). The predetermined cleaning bias is applied to the secondary cleaning roller 73 by way of the primary cleaning roller 72.

The cleaning blade 74 is formed from a thin-plate-like scraper blade, and the extremity of the cleaning blade 74 is positioned so as to contact a lower portion of the secondary cleaning roller 73 in an essentially-horizontal direction.

Deposits, such as the toner adhering to the transport belt 64 as a result of the belt having contacted the photosensitive drum 42 or the paper dust adhering to the transport belt 64 as a result of the transport belt having contacted the sheet of paper 3, are electrically captured by the primary cleaning roller 72 when the deposits have opposed the primary cleaning roller 72 by means of moving action of the transport belt 64. Subsequently, the thus-captured deposits are electrically captured by the secondary cleaning roller 73 when having opposed the secondary cleaning roller 73 as a result of rotation of the primary cleaning roller 72. The deposits are then scraped off by the cleaning blade 72, and the thus-scraped deposits are stored in the removed-substance storage section within the cleaning box 71.

Figure 2:
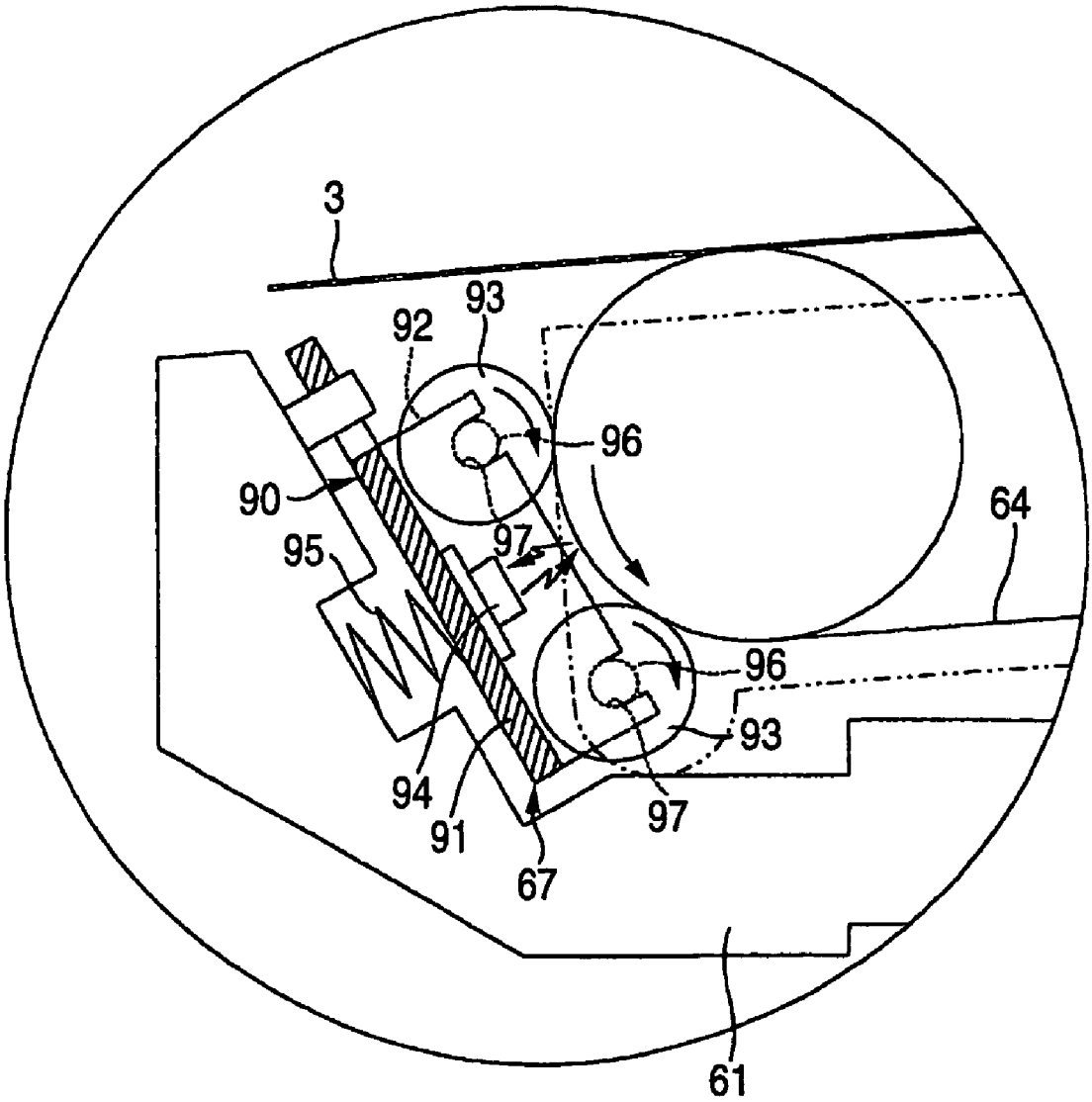
FIG. 2 is a side cross-sectional view of a press mechanism shown in FIG. 1.
Figure 3:
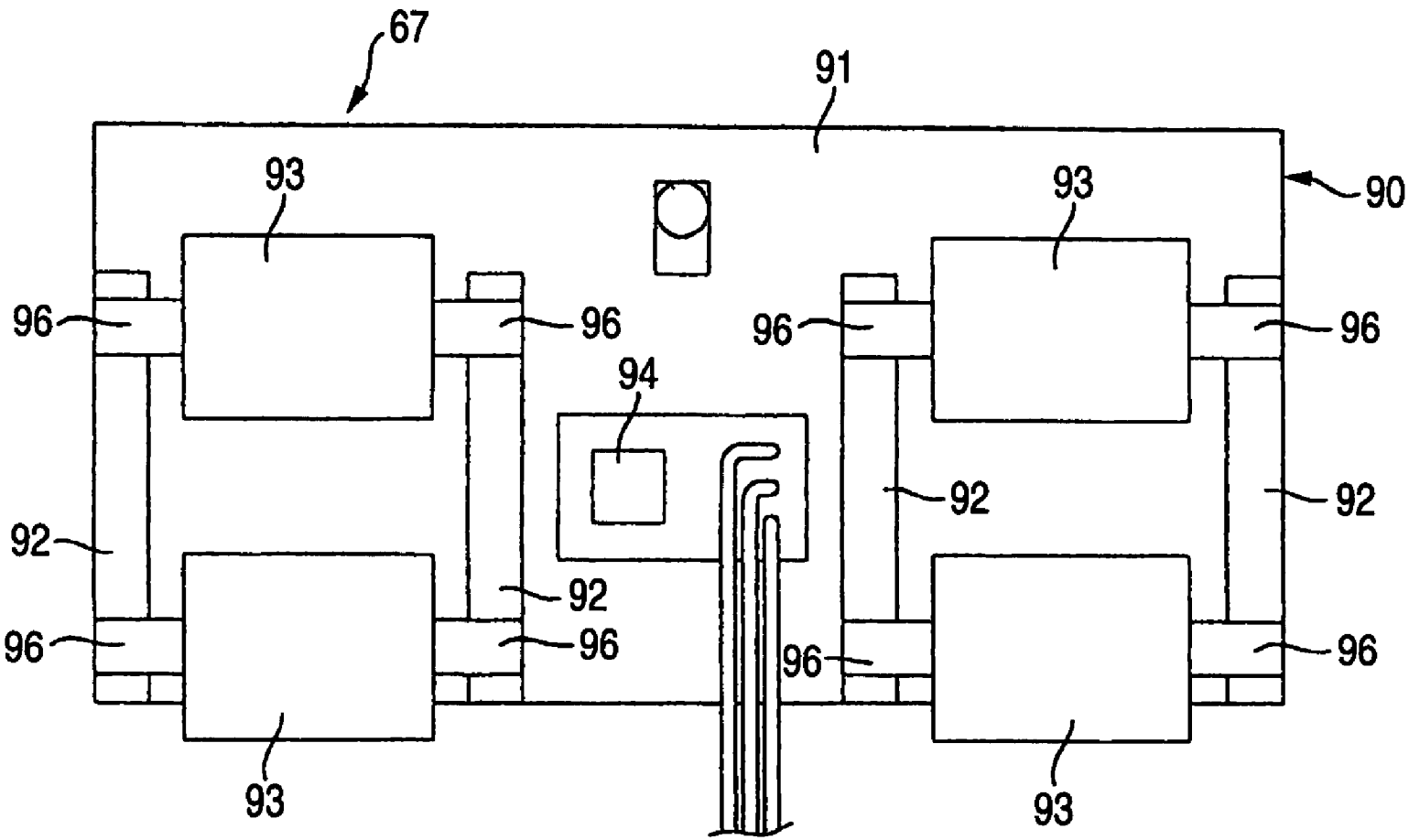
FIG. 3 is a front view of the press mechanism shown in FIG. 1.

The press mechanism 67 is placed at a position on the transport belt 64 below the plane including the plane where the sheet of paper 3 is transported. As shown in FIGS. 2 and 3, the press mechanism 67 has a holder 90 which is formed from a holder main body 91 and four support plates 92 and acts as a retaining member; press rollers 93 acting as four press members retained by the holder 90; and a press spring 95 for impelling the holder 90 toward the transport belt 64.

The holder main body 91 is formed into the shape of an essentially-rectangular plate, and is positioned opposite the transverse center of the area of the transport belt 64, where the transport belt contacts the drive roller 62, along a backwardly downward oblique direction from the drive roller 62 and transversely extends at an inclination where the lower portion of the holder main body faces the front.

Of the four support plates 92, two plates form a pair. Two pairs of support plates 92 are provided upright at both transverse ends of the face of the holder main body 91 opposing the transport belt 64. In each pair, the two support plates 92 are spaced a given interval apart from and opposite each other in the transverse direction, and extend in a direction orthogonal to the transverse direction. An essentially-circular bearing indentation section 97 for receiving a roller shaft 96 of the press roller 93, which will be described later, is formed at both ends, in the extending direction of the support plate 92, in the face of each support plate 92 opposing the transport belt 64.

Four press rollers 93 are supported in pairs by the respective pairs of support plates 92. In each pair of support plates 92, the two press rollers 93 are spaced apart from each other in the extending direction of the support plate 92. The roller shaft 96 protruding from both ends of each press roller 93 is rotationally received by the bearing indentation sections 97 of the support plate 92. Each of the press rollers 93 contacts a downstream area of the transport belt 64 in the transporting direction thereof (i.e., a lower left quarter area of the drive roller 62 in FIG. 2), in the transverse center of the portion of the transport belt 64 contacting the drive roller 62 (a portion contacting a left half of the rive roller 62 in FIG. 2). In association with movement of the transport belt 64, each of the press rollers 93 rotates in the transporting direction of the transport belt 64 (in the clockwise direction in FIG. 2) at a position where the press roller contacts the transport belt 64.

Each of the press rollers 93 is formed by applying fluororesin coating to the surface of a roller molded from POM (polyacetal) resin through injection molding. The capability of each press roller 93 for eliminating deposits from the transport belt 64 is lower than the capability of the primary cleaning roller 72 for eliminating deposits from the transport belt 64.

The press spring 95 is placed at a position opposite the drive roller 62 with the holder main body 91 interposed therebetween. One end of the press spring 95 is fastened to the frame 61, and the other end of the same is fastened to the holder main body 91. The press spring 95 impels the holder main body 91 toward the transport belt 64, whereby the four press rollers 93 retained by the holder 90 are pressed against the transport belt 64.

A reflection sensor 94 employed as a sensor incorporating a light-projecting element and a light-receiving element is provided at a substantial center of the face of the holder main body 91 opposing the transport belt 64. This reflection sensor 94 is situated in an essentially center position on the transport belt 64 in the transverse direction thereof. As shown in FIG. 2, when viewed from the side, the reflection sensor 94 takes, as a detection target region, a location between the position where an upstream position of the transport belt 64 in the transporting direction thereof is pressed by the press roller 93 and the position where a downstream position of the transport belt 64 in the transporting direction thereof is pressed by the press roller 93. The reflection sensor 94 is for detecting the surface status of the transport belt 64. For example, the reflection sensor 94 is a sensor for detecting the densities of patches of respective colors experimentally formed in a detection target area on the surface of the transport belt 64 and the transfer efficiency of a toner image of each color or the quantity of toner, or a color registration sensor for detecting a transfer offset of a toner image of each color by detecting a color offset in the patch formed by experimentally superimposing colors in the detection target region.

The fusing section 29 is disposed behind the transfer section 28. This fusing section 29 has a heating roller 82 and a pressure roller 83.

The heating roller 82 is formed from the metal original pipe, wherein a mold releasing layer is formed on the surface of the metal original pipe. A halogen lamp is incorporated in the heating roller along the axial direction thereof. The surface of the heating roller 82 is heated to a fusing temperature by means of the halogen lamp. The pressure roller 83 is provided so as to press the heating roller 82.

The color image transferred onto the sheet of paper 3 is transported to the fusing section 29, and the sheet of paper 3 is thermally fused while passing between the heating roller 82 and the pressure roller 83.

The paper eject section 6 has a U-shaped paper-eject path 84, a paper eject roller 85 functioning as an ejecting unit, and a paper eject tray 86.

An upstream end portion of the U-shaped paper eject path 84 is adjacent to the fusing section 29 at a lower position. A downstream end of the U-shaped paper eject path 84 is adjacent to the paper eject tray 86 at an upper position such that the sheet of paper 3 is fed rearward. The path is formed as an essentially-U-shaped transport path such that the sheet of paper 3 is fed forward.

The paper eject roller 85 is provided as a pair of rollers at the downstream end of the U-shaped paper-eject-side path 84.

The paper eject tray 86 is formed as an inclined wall, which is downwardly inclined from front to back, on the upper surface of the main body casing 2.

The sheet transported from the fusing section 29 is backwardly fed to the upstream end portion of the U-shaped paper eject path 84. In the U-shaped paper eject path 84, the transporting direction of the sheet is inverted, and the sheet is then forwardly eject to the paper eject tray 86 by means of the paper eject roller 85.

As mentioned above, in this color laser printer 1, the transport belt 64 is pressed against the drive roller 62 by the press roller 93. Therefore, the transport belt 64 is forcefully pressed against the primary cleaning roller 72 by the impelling roller 76 (the primary cleaning roller 72 is forcefully pressed against the transport belt 64). Even when a sag has arisen in the transport belt 64 between the drive roller 62 and the primary cleaning roller 72 as a result of pressing action, the transport belt 64 can be prevented from lifting from the drive roller 62. Consequently, an attempt to enhance cleaning capability of the cleaning device 66 can be realized, and the transport belt 64 can be stably driven.

A point on the transport belt 64 where the transport belt contacts the drive roller 62, or a downstream point on the transport belt 64 in the transporting direction thereof, is a location where the transport belt 64 is particularly likely to rise from the drive roller 62. In this color laser printer 1, the point is pressed against the drive roller 62 by the press roller 93, so that superior contact of the transport belt 64 with the drive roller 62 can be ensured. Therefore, the transport belt 64 can be stably driven.

Each of the respective press rollers 93 is rotationally retained by the holder 90, and hence rotates in association with movement of the transport belt 64. Therefore, pressing of the transport belt 64 performed by the respective press rollers 93, which would become a load against travel of the transport belt 64, can be lessened. Consequently, the belt can be driven more stably.

Moreover, a plurality of points on the transport belt 64, which differ from each other in the transporting direction thereof, can be pressed by the plurality of press rollers 93. Hence, the transport belt 64 can be pressed in a well-balanced manner. Therefore, the transport belt 64 can be more stably driven.

In order to press the press rollers 93 against the transport belt 64 without fail, the holder 90 integrally retaining the plurality of press rollers 93 is positioned with high accuracy with regard to the transport belt 64. As a result of the reflection sensor 94 being arranged in the holder main body 91 of the holder 90, the reflection sensor 94 can be placed with high positional accuracy with respect to the transport belt 64. Therefore, the detection accuracy of the reflection sensor 94 can be enhanced.

Moreover, lifting of the transport belt 64 from the drive roller 62 can be prevented most reliably in a location between the position where an upstream portion of the transport belt 64 in the traveling direction thereof is pressed by the press roller 93 and the position where a downstream portion of the transport belt 64 in the traveling direction thereof is pressed by the press roller 93. Accordingly, the reflection sensor 94, which takes such a location as a detection target region, can well detect the surface status of the transport belt 64.

In addition, in this color laser printer 1, the reflection sensor 94 is interposed between the pair of press rollers 93 positioned on one side in the transverse direction and another pair of press rollers 93 positioned on the other side. A region on the surface of the transport belt 64, which is located between transverse ends which the press rollers 93 come into contact, is taken as a detection target region. A patch experimentally formed in such a detection target region does not contact the press roller 93. Hence, the status (i.e., the density or color offset) of the patch can be detected very well by the reflection sensor 94.

The capability of each press roller 93 for eliminating deposits from the transport belt 64 is lower than the capability of the primary cleaning roller 72 for eliminating deposits from the transport belt 64. Hence, the deposits to be eliminated by the primary cleaning roller 72 (the cleaning device 66) can be prevented from being eliminated by the respective press rollers 92. Therefore, steady contamination of the adjacent areas of the respective press rollers 93, which would otherwise be caused when the respective press rollers 93 have become stained, can be prevented.

The press mechanism 67 (the press rollers 93) is placed in a position below the plane including the plane where the sheet of paper 3 is transported by the transport belt 64. Therefore, collision of the sheet of paper 3 transported by the transport belt 64 with the press mechanism 67 can be avoided.

The drive roller 62, the driven roller 63, the transport belt 64, the transfer roller 65, the cleaning device 66, and the press mechanism 67 are retained by the frame 61 which is removably attached to the main body casing 2. Therefore, these members can be integrally attached to or detached from the main body of the apparatus. Therefore, operation for replacing these members can be facilitated.

The cleaning device 66 is placed in the comparatively-large space formed in close proximity to the driven roller 63 between the bottom face of the frame 61 and the transport belt 64. The large space can be effectively utilized. Therefore, an attempt to miniaturize the apparatus can be realized.

As mentioned previously, in this color laser printer 1, the direction in which the pickup roller 22 of the paper-feeding section 4 forwardly picks up the sheet of paper 3 is opposite to the direction in which the sheet of paper 3 is rearwardly transported at the respective image-forming positions. Further, the direction in which the sheet of paper 3 is rearwardly transported at the respective image-forming positions is opposite to the direction in which the sheet of paper 3 is forwardly eject by the paper eject roller 85 in the paper eject section 6. Therefore, an attempt to miniaturize the apparatus can be realized while ensuring the transport path for the sheet of paper 3.

In this color laser printer 1, in the respective process sections 27, the process cartridges 31 are attached or detached in a direction inclined with respect to the longitudinal direction and the vertical direction (the thicknesswise direction of the sheet of paper 3); namely, a direction rearwardly inclined from up to down. Therefore, an attempt can be made to enhance operability required at the time of attachment or detachment of the process cartridge 31.

In this color laser printer 1, the plurality of process cartridges 31 and the plurality of corresponding scanner units 30 are positioned one after another in the longitudinal direction. An attempt to miniaturize the apparatus can be realized by means of such an efficient arrangement of the process cartridges and the scanner units.

Figure 4:
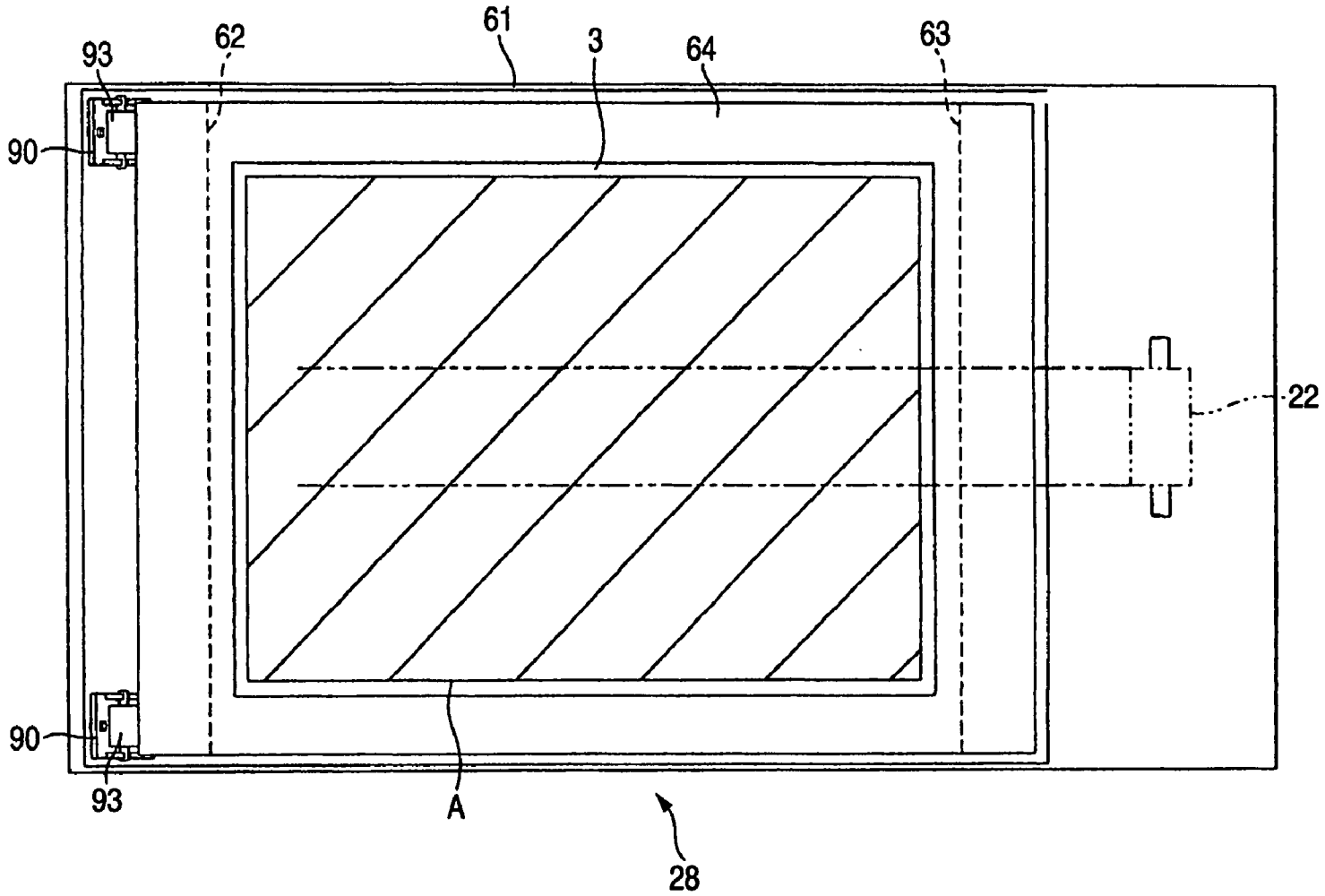
FIG. 4 is a plan view showing a second embodiment of a transfer section (an embodiment where a transport belt is pressed outside an area where the belt contacts a sheet of paper)

FIG. 4 is a plan view showing a second embodiment of the transfer section 28. In relation to the sections corresponding to the above-described individual sections, those sections which are the same as those shown in FIG. 4 are assigned the same reference numerals, and their repeated explanations are omitted.

In the transfer section 28 shown in FIG. 4, a plurality of press rollers 93 are arranged so as to contact both transverse ends of the transport belt 64. More specifically, the plurality of press rollers 93 are individually retained by the holder 90 and arranged to press the transport belt 64 outside an area opposing the region on the sheet of paper 3 where the pickup roller 22 contacts the sheet of paper (an area between straight lines indicated by a two-dot chain line shown in FIG. 4), outside an area opposing the image-forming region on the photosensitive drum 42 (see FIG. 1), and outside the area where the sheet of paper 3 contacts the transport belt (the area in FIG. 4 where the sheet of paper 3 is shown).

The image-forming region is an area on the surface of the photosensitive drum 42 where a toner image can be carried. The image-forming region has the same width as that of an image-formation possible region (a printable region) A on the sheet of paper 3 shown in FIG. 4. Mary deposits, such as toner, adhere to areas on the surface of the transport belt 64 opposing the image-forming regions. Therefore, occurrence of steady contamination of the adjacent areas of the respective press rollers 93, which would otherwise be caused when the deposits migrate to and stain the press roller 93 as a result of the press roller 93 being pressed outside the area opposing the image-forming regions, can be prevented.

An especially large amount of deposits, such as paper dust, adhere to the region on the surface of the transport belt 64 opposing the area on the sheet of paper 3 where the pickup roller 22 contacts the sheet of paper. Even in the case of an area other than the region, large amounts of deposits, such as paper dust or toner, adhere to the area on the transport belt which contacts the sheet of paper 3. Accordingly, migration of the deposits to the press rollers 93, which would stain the press roller, can be prevented further by pressing the press roller 93 outside the area where the sheet of paper 3 contacts the transport belt.

Figure 5:
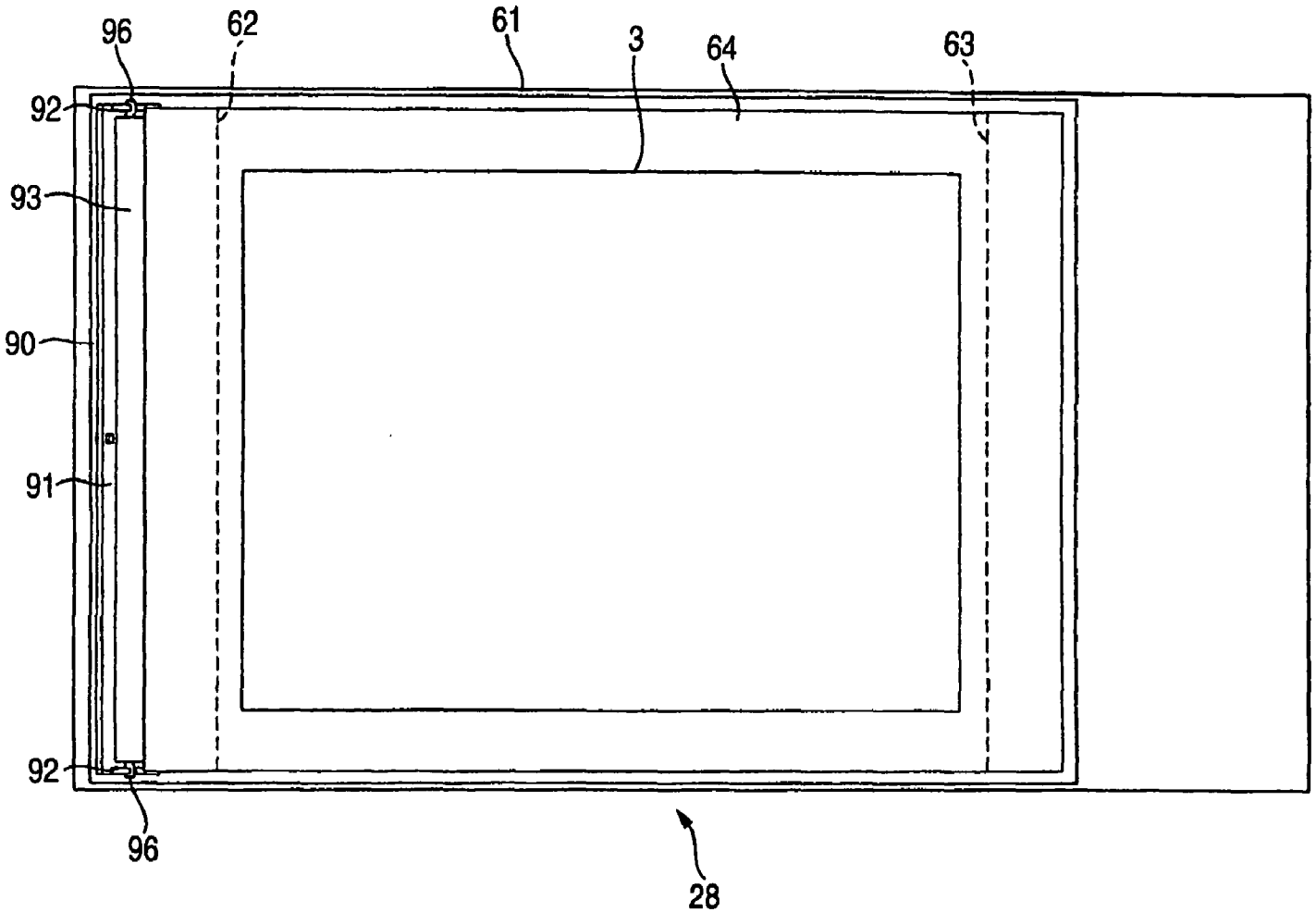
FIG. 5 is a plan view showing a third embodiment of the transfer section (an embodiment where the transport belt is pressed across the entire width thereof)

FIG. 5 is a plan view showing a third embodiment of the transfer section 28. In relation to the sections corresponding to the above-described individual sections, those sections which are the same as those shown in FIG. 5 are assigned the same reference numerals, and their repeated explanations are omitted.

In the transfer section 28 shown in FIG. 5, a plurality of press rollers 93 are formed long in the transverse direction and arranged so as to press essentially the entire width of the transport belt 64 in the transverse direction thereof. More specifically, the holder 90 retaining the press rollers 93 is formed such that the length of the holder main body 91 in the transverse direction thereof becomes greater than the length of the transport belt 64 in the transverse direction thereof. The support plates 92 are provided upright on both ends of the holder main body 91. The roller shaft 96 projecting from both ends of the press rollers 93 is rotationally supported by the support plates 92.

By means of such a configuration, the press roller 93 can press essentially the entire width of the transport belt 64 in the transverse direction thereof. Therefore, exertion of local load on the press roller 93 can be prevented. Therefore, the belt can be driven more stably.

Figure 6:
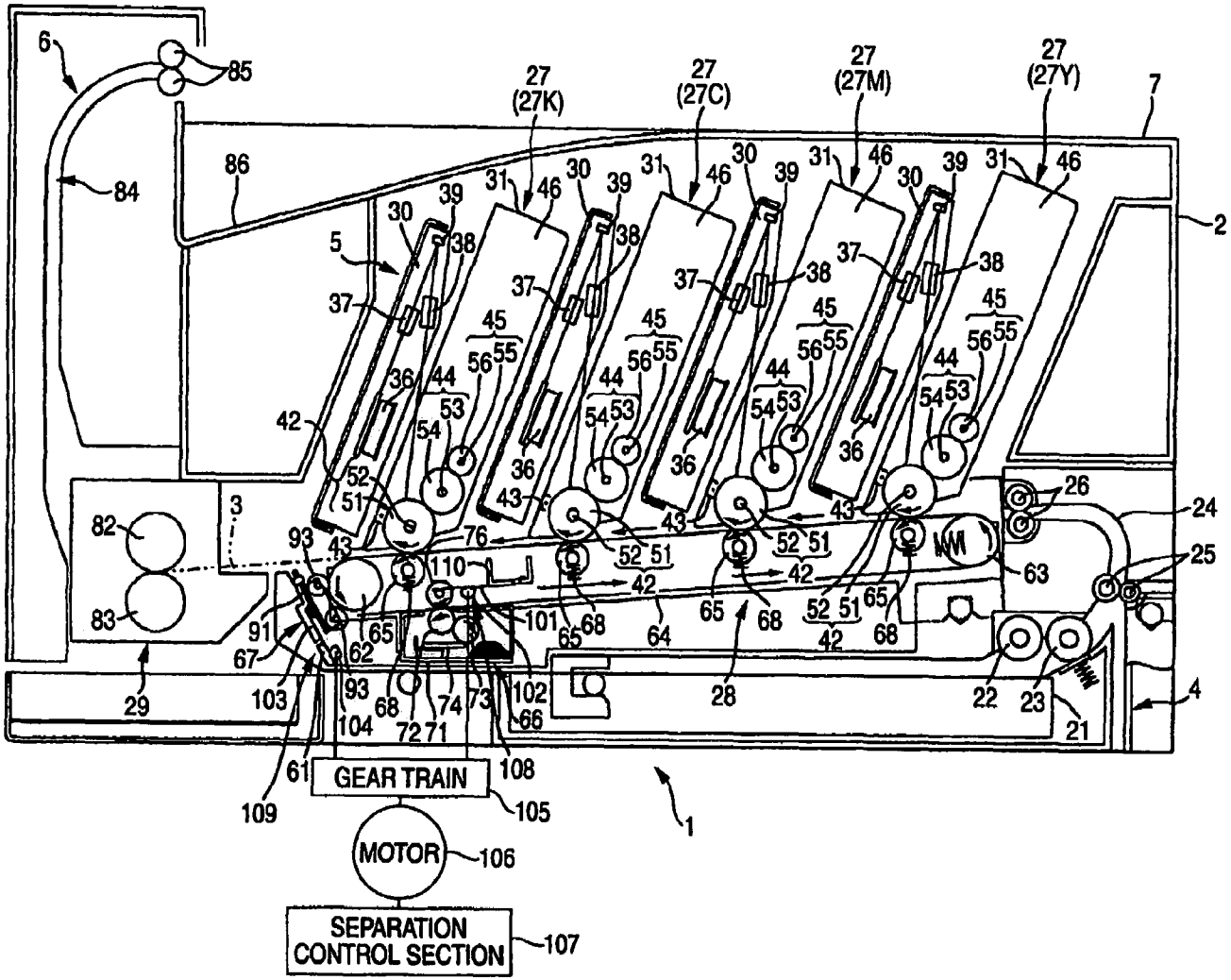
FIG. 6 is a side cross-sectional view showing a fourth embodiment of the color laser printer (an embodiment where the color laser printer has a cleaning contacting/separating mechanism and a press roller contacting/separating mechanism), showing a state where a primary cleaning roller, a press roller, and a transport belt are pressed.
Figure 7:
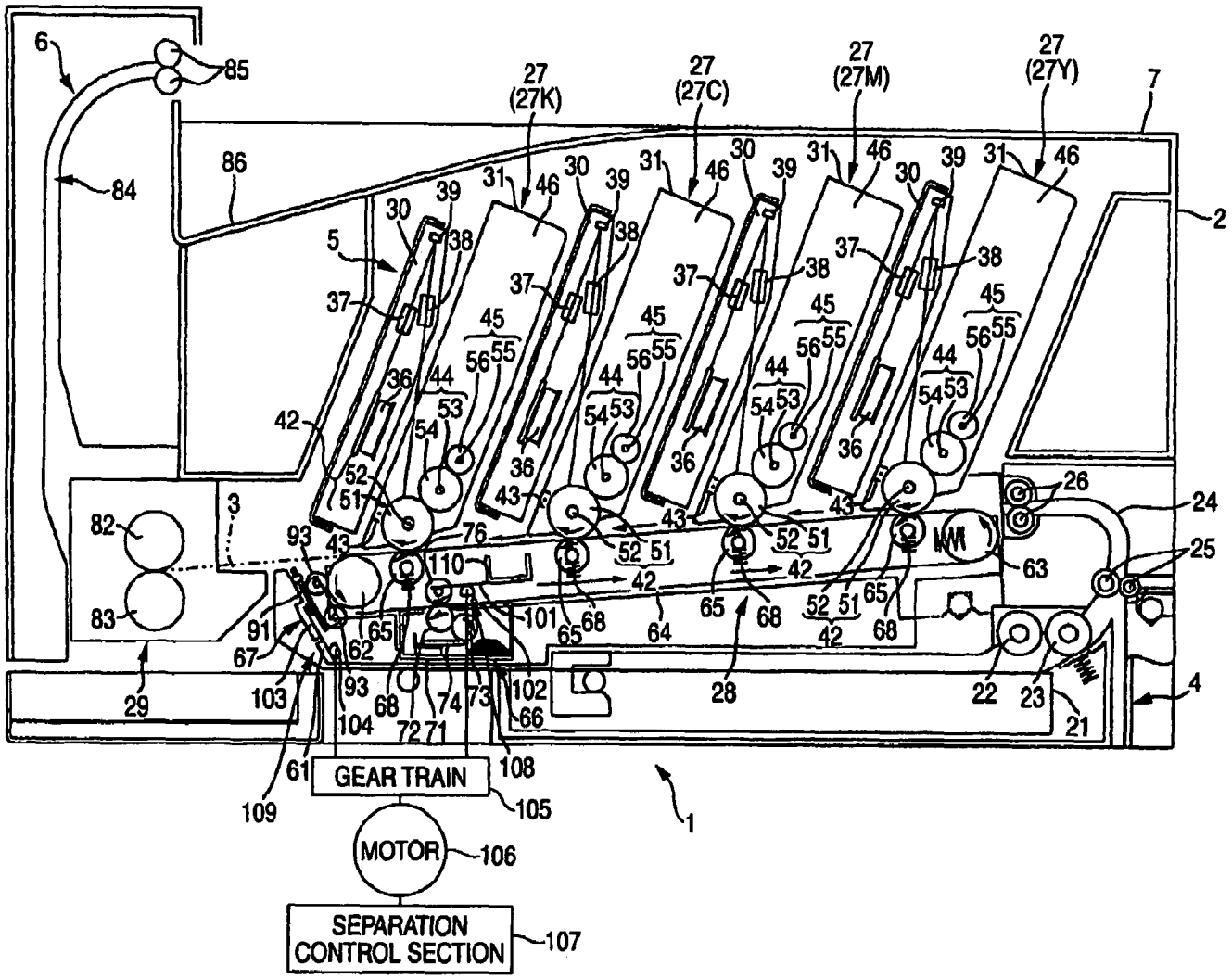
FIG. 7 is a side cross-sectional view showing a fourth embodiment of the color laser printer (an embodiment where the color laser printer has the cleaning contacting/separating mechanism and the press roller contacting/separating mechanism), showing a state where the primary cleaning roller, the press roller, and the transport belt are released from a pressed state.

FIGS. 6 and 7 are side cross-sectional views showing a fourth embodiment of the color laser printer 1. In relation to the sections corresponding to the above-described individual sections, those sections which are the same as those shown in FIGS. 6 and 7 are assigned the same reference numerals, and their repeated explanations are omitted.

This color laser printer 1 comprises a cleaning roller contacting/separating mechanism 108 serving as a contact force reduction mechanism which reduces the contact force of the primary cleaning roller 72 exerted on the surface of the transport belt 64 by moving the primary cleaning roller 72 so as to contact or separate from the surface of the transport belt 64; and a press roller contacting/separating mechanism 109 functioning as a pressing force reduction mechanism which reduces the pressing force of the press roller 93 exerted on the transport belt 64 by moving the press roller 93 so as to contact and separate from the surface of the transport belt 64.

The cleaning roller contacting/separating mechanism 108 has a fixed section 110 fixedly arranged on the frame 61; a leaf spring 101 whose one end is fastened to the fixed section 110 and extends rearward; and a cam 102 positioned opposite the leaf spring 101 so as to contact the leaf spring 101 from below. An extremity of the leaf spring 101 contacts a rotary shaft of the impelling roller 76 from above, thereby impelling the impelling roller 76 toward the primary cleaning roller 72 by means of the elastic force of the leaf spring 101.

The press roller contacting/separating mechanism 109 has a swaying plate 103 which extends essentially in parallel to the holder main body 91 at a position rearward of the holder main body 91, and a cam 104 which is positioned opposite the swaying plate so as to contact the lower end portion of the swaying plate 103 from the front. The upper end portion of the swaying plate 103 contacts the holder main body 91, and any position on the swaying plate 103 in the vertical direction thereof is supported by protuberances projecting from the frame 61 toward the swaying plate 103.

The color laser printer 1 comprises a motor 106 which generates driving force used for rotating the cam 102 and the cam 104; a gear train 105 for transmitting the driving force of the motor 106 to the cam 102 and the cam 104; and a separation control section 107 for controlling the motor 106. The separation control section 107 is formed from a microcomputer formed from, e.g., a CPU, RAM, and ROM.

As shown in FIG. 6, in this color laser printer 1, an essentially flat face of the cam 102 contacts the leaf spring 101 during a period requiring cleaning operation, and an essentially-circular-arc face of the cam 104 contacts the swaying plate 103. The leaf spring 101 contacts a rotary shaft of the impelling roller 76, to thus impel the impelling roller 76 toward the primary cleaning roller 72. The primary cleaning roller 72 and the transport belt 64 are brought into pressed contact with each other as a result of the impelling roller 76 having pressed the transport belt 64. The upper end portion of the swaying plate 103 is lifted toward the holder main body 91, and the press roller 93 is pressed against the transport belt 64 by pressing the holder main body 91 toward the drive roller 62.

After lapse of, e.g., a given period of time since completion of the image-forming operation, the motor 106 is controlled by the separation control section 107. As shown in FIG. 7, the cam 102 and the cam 104 are rotated such that the essentially-circular-arc face of the cam 102 contacts the leaf spring 101 and such that the essentially-flat face of the cam 104 contacts the swaying plate 103. As a result, the leaf spring 101 separates from the rotary shaft of the impelling roller 76, whereupon the impelling force of the impelling roller 76 provided by the leaf spring 101 disappears. The primary cleaning roller 72 and the transport belt 64 are released from pressed contact. The upper end portion of the swaying plate 103 descends, and the holder main body 91 descends as well. Thereby, the press roller 93 separates from the transport belt 64.

As mentioned above, when cleaning operation is not performed, the primary cleaning roller 72 and the press roller 93 can be separated from the transport belt 64. Therefore, the stress resulting from the primary cleaning roller 72 and the press roller 93 pressing the transport belt 64 can be mitigated.

Although the cleaning roller contacting/separating mechanism 108 is preferably configured to bring the primary cleaning roller 72 into or out of contact with the surface of the transport belt 64, the mechanism may also be configured to increase or decrease the contacting force of the primary cleaning roller 72 exerted on the transport belt 64 while the primary cleaning roller 72 remains in contact with the transport belt 64. Moreover, although the press roller contacting/separating mechanism 109 is preferably configured to cause the press roller 93 to contact or separate from the surface of the transport belt 64, the mechanism may be configured to increase or decrease the pressing force of the press roller 93 exerted on the transport belt 64 while the press roller 93 remains in contact with the transport belt 64, Specifically, when cleaning operation is not performed, the primary cleaning roller 72 and the press roller 93 do not need to be completely separated from the surface of the transport belt 64, and the essential requirement is to reduce the contacting force of the primary cleaning roller 72 exerted on the transport belt 64 and the pressing force of the press roller 93 exerted on the transport belt 64.

The above descriptions have illustrated the tandem color laser printer 1 that directly transfers images from the respective photosensitive drums 42 to the sheet of paper 3. However, the present invention is not limited to this type of printer. For instance, the present invention can also be configured as a color laser printer of intermediate transfer type which transfers toner images of respective colors from respective photosensitive members to an intermediate transfer body and collectively transfers the images to a sheet. Moreover, the present invention can also be configured as a monochrome laser printer.

Although the transport belt 64 is passed around the drive roller 62 and the driven roller 63, another drive roller and another driven roller may be provided in addition to the drive roller 62 and the driven roller 63, and the transport belt 64 may be passed around these three or more rollers. In this case, it is better to position the press mechanism 67 with respect to the cleaning device 66 such that the transport belt 64 is pressed against a drive roller disposed closest to a position on the transport belt 64 in the traveling direction thereof which is upstream of the position of the cleaning device 66.

The above descriptions have illustrated the configuration where the cleaning device 66 is retained by the frame 61 along with the drive roller 62, the driven roller 63, the transport belt 64, the transfer roller 65, and the press mechanism 67, but the cleaning device 66 may be not retained by the frame 61 but fixedly positioned on the main body casing 2.

Further, the frame 61 may be given a frame-shaped structure not having a bottom surface. In such a case, the cleaning device 66 is preferably positioned in a comparatively-large space (a space larger than the space formed at a position in close proximity to the drive roller 62) formed in a position which is located between the transport belt 64 and the upper surface of the sheet of paper 3, which is located below the transport belt and serves as an opposing member housed in the paper-feeding tray 21, and in close proximity to the driven roller 63.

What is claimed is:

1. An image forming apparatus comprising:

a plurality of rollers including at least one drive roller to be rotatively driven;

a belt passed around the plurality of rollers;

a press member which is disposed opposite the drive roller with the belt interposed therebetween and presses the belt against the drive roller;

a retaining member; and cleaning member which comes into contact with a surface of the belt at a position downstream of the drive roller along a travel direction of the belt to eliminate a deposit adhering to the surface of the belt, wherein the press member includes a plurality of press members provided along the travel direction of the belt, and the retaining member integrally retains at least two of the plurality of press members.

2. The image forming apparatus according to claim 1, wherein a capability of the press member to eliminate a deposit on the belt is lower than a capability of the cleaning member to eliminate the deposit on the belt.

3. The image forming apparatus according to claim 1, wherein the press member presses an area of the belt downstream of a point where the belt remains in contact with the drive roller, along a travel direction of the belt.

4. The image forming apparatus according to claim 1, wherein the press member is a press roller which follows movement of the belt.

5. The image forming apparatus according to claim 1, further comprising a sensor which is retained by the retaining member and which detects a status of a surface of the belt.

6. The image forming apparatus according to claim 5, wherein the sensor detects the status of the surface of the belt while taking, as a detection target region, an area between a press position on the belt surface which is pressed by the press member positioned upstream of the belt in a travel direction thereof and a press position on the belt surface which is pressed by the press member positioned downstream of the belt in a travel direction thereof.

7. The image forming apparatus according to claim 1, wherein the belt includes a transport belt that transports a recording medium; and press members are positioned out of a plane including a surface of the belt on which a recording medium is transported.

8. The image forming apparatus according to claim 1, further comprising:

a main body; and a frame that is removably attached to the main body;

wherein the frame integrally retains the plurality of rollers, the belt, and the press member to allow the plurality of rollers, the belt, and press members to be integrally detached from the main body.

9. The image forming apparatus according to claim 1, further comprising:

an opposing member opposing to the belt;

wherein the belt is positioned obliquely with respect to the opposing member such that an interval between the rollers exclusive of the drive roller and the opposing member becomes greater than an interval between the drive roller and the opposing member; and a cleaning member is positioned between the belt and the opposing member in a space in close proximity to the rollers other than the drive roller.

10. An image forming apparatus comprising:

a plurality of rollers including at least one drive roller to be rotatively driven;

a belt passed around the plurality of rollers;

a press member which is disposed opposite the drive roller with the belt interposed therebetween and presses the belt against the drive roller;

process cartridges of respective colors, each having an image forming member that forms an image on a recording medium;

a feeding unit that picks up and feeds a recording medium; and an ejecting unit that ejects the recording medium;

wherein the process cartridges of respective colors are interposed between the feeding unit and the ejecting unit in a path over which the recording medium is transported;

a pickup direction in which the recording medium is picked up by the feeding unit is opposite to a transporting direction of the recording medium achieved at an image forming position where images are sequentially formed by the process cartridges of respective colors; and the transporting direction of the recording medium achieved at the image forming position is opposite to the direction in which the recording medium is ejected by the ejecting unit;

wherein the process cartridge is detachable in a direction inclined to the transporting direction of the recording medium at the image forming position and a thickness wise direction of the recording medium orthogonal to the transporting direction.

11. The image forming apparatus according to claim 10, further comprising:

a plurality of exposure devices each provided in association with each of the process cartridges of respective colors; and the process cartridges of respective colors and the plurality of exposure devices associated therewith are alternately positioned in the transporting direction of the recording medium at the image forming position.

12. A belt device to be removably attached to an image forming apparatus that has a main body, the device comprising:

a plurality of rollers including at least one drive roller to be rotatively driven;

a belt passed around the plurality of rollers;

a press member disposed opposite the drive roller with respect to the belt and presses the belt against the drive roller;

a frame retains the plurality of rollers, the belt, and the press member so that the plurality of rollers, the belt, and the press member can be integrally removed from or attached to the main body;

a retaining member; and a cleaning member which comes into contact with a surface of the belt at a position downstream of the drive roller along a travel direction of the belt to eliminate a deposit adhering to the surface of the belt, wherein the press member includes a plurality of press members provided along the travel direction of the belt; and the retaining member integrally retains at least two of the plurality of press members.

* * * * *

UNITED STATES PATENT AND TRADEMARK OFFICE

CERTIFICATE OF CORRECTION

PATENT NO. : 7,391,988 B2
APPLICATION NO. : 11/258930
DATED : June 24, 2008
INVENTOR(S) : Hiroshi Igarashi et al.

It is certified that error appears in the above-identified patent and that said Letters Patent is hereby corrected as shown below:

Column 14, Claim 1, Line 9:
Please replace “cleaning member” with --a cleaning member--.

Signed and Sealed this

Twenty-first Day of April, 2009

JOHN DOLL
*Acting Director of the United States Patent and Trademark Office*